US006083147A

United States Patent [19]

Ehnström et al.

[11] Patent Number: 6,083,147

[45] Date of Patent: Jul. 4, 2000

[54] APPARATUS AND METHOD FOR DISCONTINUOUS SEPARATION OF SOLID PARTICLES FROM A LIQUID

[75] Inventors: Lars Ehnström, Tullinge; Hyosong Lee, Tumba, both of Sweden

[73] Assignee: Centritech HB, Norsborg, Sweden

[21] Appl. No.: 09/000,119

[22] PCT Filed: Jul. 24, 1996

[86] PCT No.: PCT/SE96/00971

§ 371 Date: Mar. 11, 1998

§ 102(e) Date: Mar. 11, 1998

[87] PCT Pub. No.: WO97/04874

PCT Pub. Date: Feb. 13, 1997

[30] Foreign Application Priority Data

Jul. 25, 1995 [SE] Sweden ..... 9502693

[51] Int. Cl.[7] ..... B04B 1/06

[52] U.S. Cl. ..... 494/37; 494/48; 494/56; 494/76

[58] Field of Search ..... 494/37, 43, 47, 494/48, 56, 76–78, 2; 366/114; 55/317, 407, 408

[56] References Cited

U.S. PATENT DOCUMENTS

| | | | |
|---|---|---|---|
| 507,442 | 10/1893 | Lentsch | 494/76 |
| 3,363,806 | 1/1968 | Blakeslee et al. | 366/114 |
| 3,695,509 | 10/1972 | Javet | 494/76 |
| 4,030,897 | 6/1977 | Pelzer et al. | 494/77 |
| 4,078,718 | 3/1978 | Putterlik | 494/2 |
| 4,432,748 | 2/1984 | Novoselac et al. | 494/2 |
| 4,784,634 | 11/1988 | Schiele | 494/2 |
| 5,073,177 | 12/1991 | Brouwers | 494/76 |
| 5,160,609 | 11/1992 | Van Der Herberg | 494/2 |
| 5,618,409 | 4/1997 | Kreill | 494/2 |
| 5,667,543 | 9/1997 | Brouwers | 55/317 |
| 5,788,621 | 8/1998 | Eady | 494/56 |

*Primary Examiner*—Charles E. Cooley

*Attorney, Agent, or Firm*—Burns, Doane, Swecker & Mathis, L.L.P.

[57] ABSTRACT

A device and a process for centrifugal separation of solid particles from a liquid is disclosed. The device comprises a vessel rotatable around a vertical axis. The vessel has a separation zone with separation surface elements. The separation surface elements are formed by a plurality of adjacent, axially oriented tubular elements or channels open at both ends. The process is characterized in that the liquid is caused to flow with essentially laminar flow through a plurality of axially oriented, parallel channels and is subjected to a g-number, preferably less than 100, in order to centrifugally deposit the particles on the channel walls.

11 Claims, 6 Drawing Sheets

APPARATUS AND METHOD FOR DISCONTINUOUS SEPARATION OF SOLID PARTICLES FROM A LIQUID

BACKGROUND

The present invention relates to a device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements. Centrifugal separators are used for among other things:

- separation and extraction of yeast, starch, kaolin and the like
- separation of oil, grease and the like from a liquid mixture
- purification and clarification of high value liquids such as beer, wine, oils etc
- purification of waste flows.

One method of making separation more effective is to increase the area of the separation surface elements and reduce the liquid depth as much as possible, which can be done by various methods. The most common method is to provide the rotor rotating about a vertical axis with conical plates provided with so-called staples, i.e. spacer elements, which guarantee a predetermined relatively small spacing between the plates, thus shortening the sedimentation distance.

Such centrifugal separators are, however, expensive to manufacture, since strict safety standards are required to prevent breakdowns which can be violent due to the large amounts of energy stored in the high-speed rotors, which generate thousands of g's. Furthermore, they consume great amounts of energy during operation. A risk of turbulent flow and breaking apart of particles is present at the inlet when the liquid is to be accelerated. Also in the gaps between the surface multiplying separation plates there is a risk of turbulent flow, which decreases the quality of separation. Emptying of sediment at the high rotational speeds disturbs the separation, and emptying is often incomplete. The emptying of sediment also uses great amounts of energy and there is the risk of clogging. Finally, the sediment can be damaged during emptying.

A major purpose of the present invention is to suggest a centrifugal separation device which eliminates in any case most of the above mentioned deficiencies in known centrifugal separators and which can fulfill the following requirements of efficient separation of both process and waste flows:

- should be able to separate small solid particles with a density close to the continuous liquid phase at moderate speeds, i.e. g-numbers below 100
- lower investment requirements than for current centrifuges with similar capacity
- lower energy requirements than for present machines with similar capacity
- must be reliable and not cause stoppages due to clogging for example, i.e. must have a high accessibility
- should be compact and simple to install
- the sediment should have high dry substance ratio
- should be able to withstand relatively aggressive liquids
- should be able to be pasteurized at temperatures slightly below 100° C.

should be able to be washed without dismantling.

Thus, a separator is sought which has the ordered laminar flow of the static separator and which, in combination with a reasonable g-number, provides a greater separation capacity at a more efficient smaller installation volume.

SUMMARY

In order to achieve this, the device described by way of introduction is characterized according to the invention in that the sedimentation surface elements are formed by a plurality of adjacent tubular elements which are oriented axially and arranged to form a ring about the center axis of the rotatable vessel and which are open at both ends. By thus arranging a very large number of axially directed tubes in the separation chamber, which have a relatively small diameter and wall thickness, a very large separation area can be obtained at the same time as an essentially laminar flow is assured through the flow channels in the tubes, where the sedimentation distance to the tube wall is short, which means that the sediment will precipitate efficiently on the walls even at a relatively reasonable rpm (g-number).

U.S. Pat. No. 3,695,509 reveals as previously known a centrifugal separator device, the separation zone of which—similar to that according to the present invention—is formed by a plurality of adjacent tube elements oriented axially and in annular formation but there is here a substantial principal difference both in the separation processes and in the structures of the devices. The device according to U.S. Pat. No. 3,695,509 is a device for continuous centrifugal separation of mixtures of liquids containing a heavy and a relatively light liquid phase, for example an emulsion of oil and water or the like, and—in accordance with FIG. 2—the liquid phases are separated by conducting the liquid mixture into an upper collection chamber, whereafter the mixture is allowed to flow through tubular channels under a high g-number of about 900–1250, so that the heavier liquid phase (e.g. water) during its transport through the tubes ends up radially outermost therein, while the lighter liquid phase (e.g. drops of oil) are pressed radially inwards. The liquid phases separated in the tubular channels are then removed continuously from the separator at different radial distances from the center axis of the rotating container.

The process and the device according to the present invention, however, deal with separating from a liquid relatively difficultly separated particles, such as solid particles, with a density close to that of a liquid, by sedimentation of the particles in a separation zone with the aid of moderate centrifugal forces. The process according to the present invention is thus a discontinuous separation process, where the separated particles are to be collected and precipitated on the tube channel walls in the separation zone, while the liquid (the effluent) which is freed from particles will flow out of the separator. When the particle concentration in the effluent begins to increase and exceeds a predetermined value as a result of clogging of the tube channels with precipitated particle sediment, the inflow of the liquid particle mixture and the rotation of the container is halted to remove the sediment from the tube walls by gravity, with or without rinsing, and thereafter emptying the sediment via a separate openable sludge outlet. The separator according to US-A-3 695 509 (FIG. 2) is not intended for and is in no way suitable for separation of particles by sedimentation thereof in the tubular channel walls shown. There is no emptying and outlet arrangement which would function for the present process. Furthermore, the high g-numbers (rpm) at which the known device operates would create excessively high compression and break-up of the particle sediment.

Suitably, the tube elements in the device according to the present invention are made of plastic, such as polypropylene or the like. Thus, the entire set of particle separating separation surface elements can be made extremely inexpensively and easily, since in principle tubular elements of simple, inexpensive suction tube type can be used in an efficient manner.

Alternatively, it is possible within the scope of the invention to replace the tubular elements with a body of rotation, where the separation surface elements are formed by the walls of a plurality of adjacent, axially oriented channels or holes in the body of rotation, which are open at both their ends.

The invention also relates to a process for discontinuous separation of solid particles from a liquid by centrifugal sedimentation thereof in which a liquid-particle mixture, which is to be separated, is conducted into an inlet chamber of a rotating separator container, where the liquid-particle mixture is caused to rotate together with the container. The particular characteristic of the process is that the liquid mixture is thereafter caused to flow with essentially laminar flow through a plurality of at-both-ends-open-ended parallel channels arranged axially and in annular formation around the center axis of the container, and which are adjacent to each other circumferentially and radially. The particles in the liquid-particle mixture flowing through the channels are subjected to a g-number of less than 500, preferably less than 100, to be precipitated by centrifugal forces on the channel walls, while the separated, purified liquid is conducted to an outlet. When the particle concentration in the purified liquid exceeds a predetermined value, the inflow of the liquid-particle mixture and the rotation of the separator container is halted for emptying of the particle sediment collected on the channel walls through an openable outlet.

BRIEF DESCRIPTION OF THE DRAWINGS

The invention will be described in more detail below with reference to the accompanying drawings, where.

DETAILED DESCRIPTION

Figure 1:
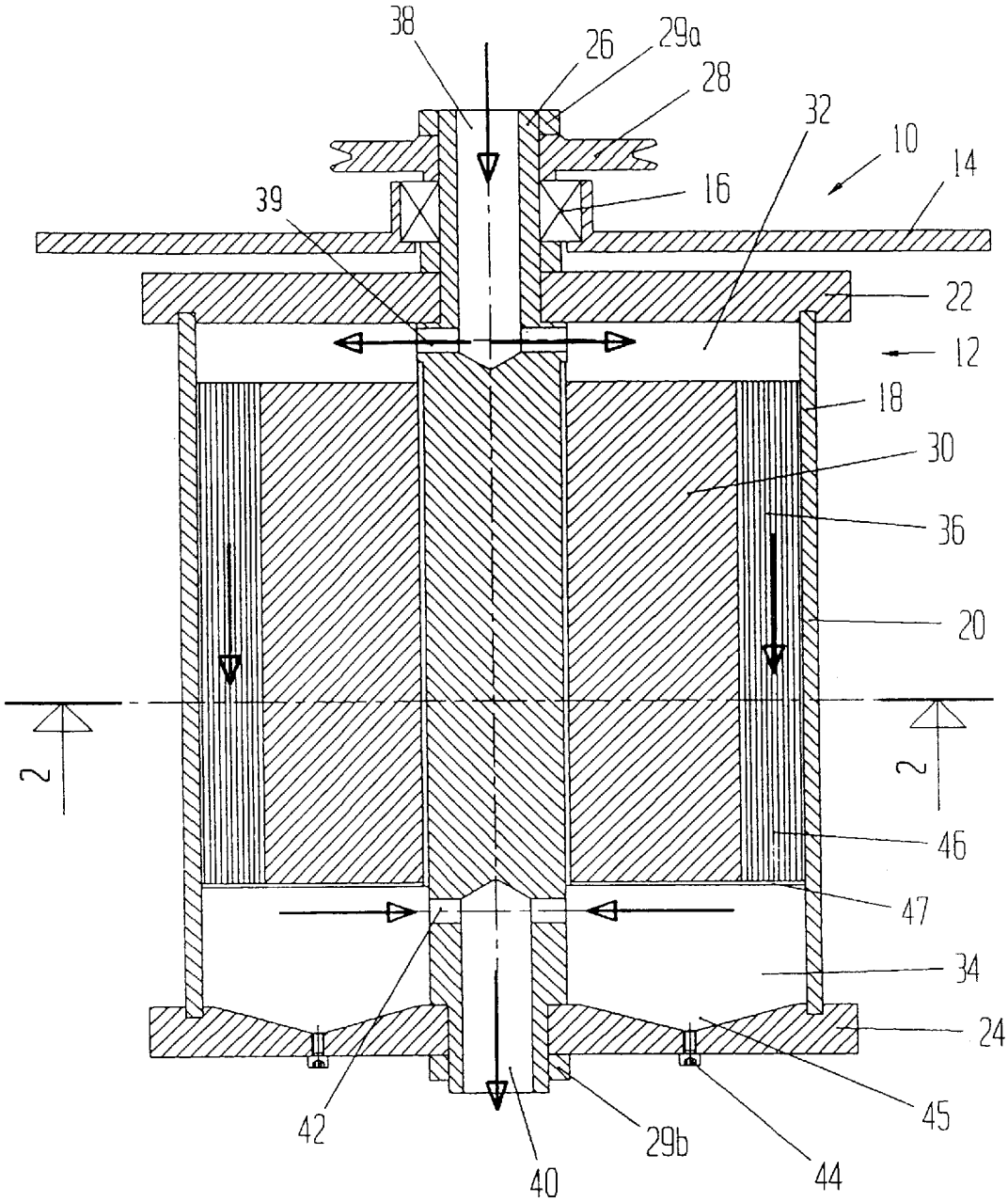
FIG. 1 is a schematic side view of a first embodiment of a separation device according to the present invention operating according to the centrifugal principle.

In FIG. 1, 10 generally designates a device working by centrifugal force according to a first embodiment of the invention. The device 10 comprises a separation rotor 12 which is rotatably carried and mounted in a carrier 14 by means of a roller bearing 16. The rotor 12 comprises a liquid-tight vessel 18 which is limited by a cylindrical wall 20 and upper and lower end walls 22 and 24, respectively, as well as a vertical rotor shaft 26 which carries at the top a non-rotatably mounted V-belt pully 28 which, via a V-belt (not shown), is in driving connection with an electric motor operating at variable speed. A pair of lock nuts 29*a*,29*b* hold together the rotor components on the carrier 14.

A filler 30 of nylon or the like, for example, is mounted on the rotor shaft 26 inside the vessel 18. At the top the filler axially limits an upper collecting chamber 32 together with the upper end wall 22. At the bottom the filler 30 axially limits a second collecting chamber 34 with the lower end wall 24. Radially outwards, the filler 30 limits an annular separation chamber or zone 36 together with the cylindrical wall 20.

At the upper portion of the rotor shaft 26 there is an inlet hole 38 for the liquid to be separated, and radially directed inlet holes 39 connect the inlet hole 38 with the upper collection chamber 32 in the vessel. In the lower portion of the rotor shaft 26 there is an outlet hole 40 for the separated liquid phase connected to the lower collection chamber 34 via radial holes 42. Sediment drain valves 44 which can be opened and closed are mounted at the bottom of a depression 45 in the lower end wall 24.

Surface-creating separation elements are arranged in the annular separation chamber 36. The separation elements are formed in accordance with the present invention by a very large number of thin walled, axially oriented tubes 46 (see especially FIG. 2). The tubes 46 preferably consist of a light material, such as plastic, e.g. PVC or polypropylene, and have a diameter less than 10 mm, preferably about 3 nim. The tubes 46 are open at both ends and rest on a rigid grate, net or sieve 47, which has a free hole area which does not prevent liquid or sediment from passing.

The device described above works in the following manner: The liquid mixture in question, which is to be separated, especially a mixture containing fine, difficultly separated particles, with a density close to that of the liquid phase, flows into the upper collection chamber 32 of the separation rotor 12 via the inlet 38 and the inlet holes 40. There the liquid mixture is accelerated to rotate together with the vessel 18. The rotational speed thereof is selected to be relatively low, so that a g-number of less than about 500, preferably less than 100, is obtained, the liquid flow through the separation chamber 36, i.e. through the tubes 46, is adapted to the sinking speed of the particles and the rpm of the separation shaft 12, and can be computed in accordance with Stoke's law or be determined experimentally. When passing through the tubes 46, the liquid mixture follows completely the rotation of the vessel 18, and this provides laminar flow and the best conditions for good separation. The sedimentation distance to the tube wall is short, which means that the particles in the liquid will be deposited on the tube walls even at relatively moderate rotational speed (g-number) and form aggregates or other type of sediments depending on the application in question, as will be described below with reference to two practical examples.

When the degree of separation shows a tendency to deteriorate, i.e. when the particle concentration in the effluent in the outlet 40 increases, this indicates that the sediment capacity of the tube package has been reached, whereupon the inlet 38 is closed and the rotation is stopped. When the flow has ceased and the rotor 12 has stopped, the concentrated sediment will slide down into the lower collection chamber 34, possibly with the aid of the remaining liquid in the vessel. The drainage valves 44 are kept open at this stage. It should be noted that the rpm during the centrifuging is selected so that the sediment will not be packed too hard against the tube walls. For certain applications, however, flushing may be required, for example at elevated temperature, or the use of cleaning chemicals. The emptying of the sediment can also be facilitated with the aid of a vibrator, such as will be described below with reference to FIG. 5. During the emptying phase, a continuous flow can be maintained in the rest of the process by means of a buffer tank (not shown) coupled to the inlet 38. The emptying phase need not take longer than a few minutes. In the embodiment shown in FIG. 1, the liquid passes through the tubes 46 in the separation chamber 36 in the downward direction by gravity.

Figure 1A:
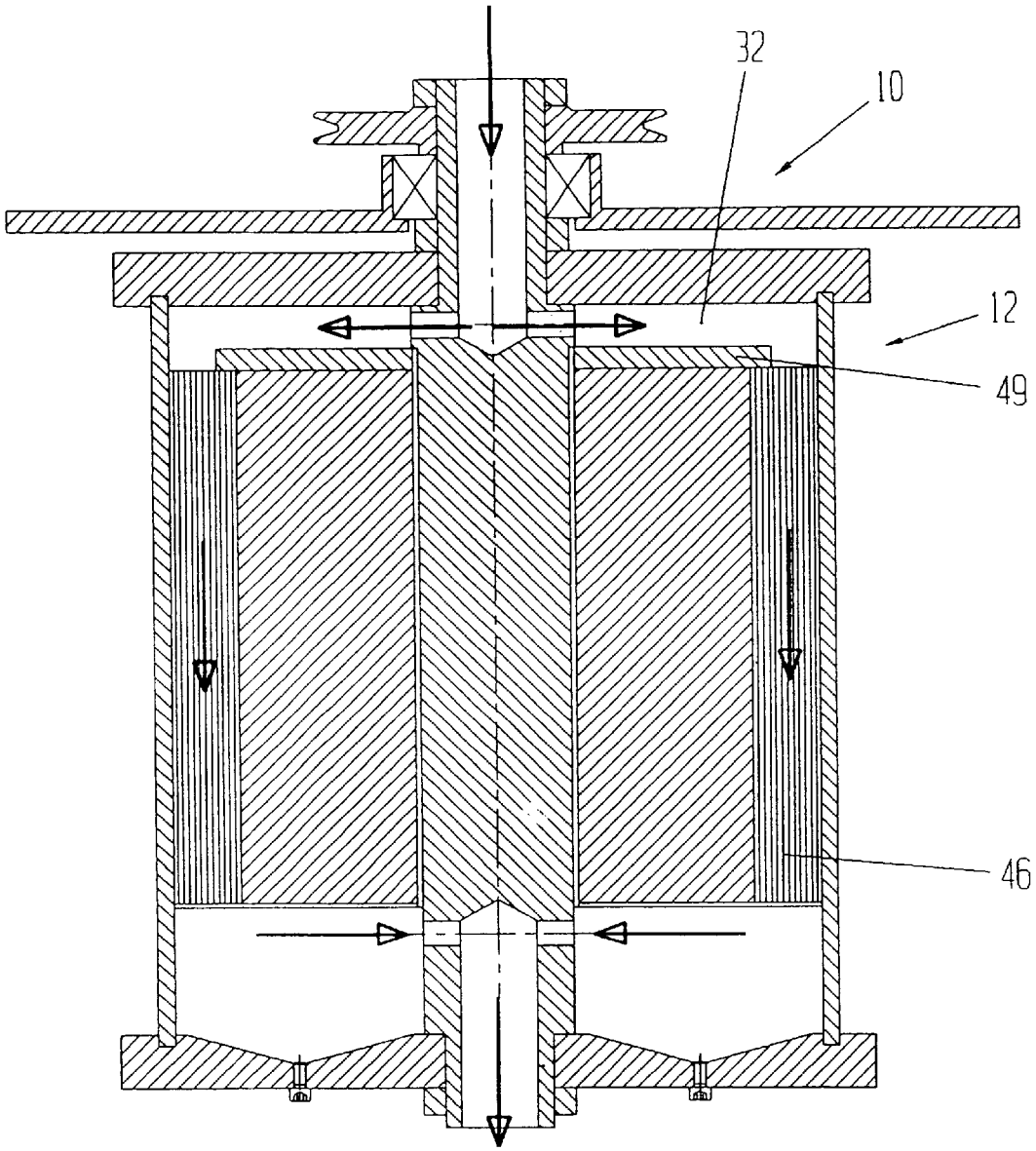
FIG. 1*a* shows the device in FIG. 1 provided with a washer steering the inlet flow to the separation zone.

FIG. 1*a* shows the separation device in FIG. 1 provided with a replaceable flow-directing washer 49 which is placed in the collection chamber 32. The washer is intended at relatively low liquid flow through the device to guide the flow out to a radially outer area of the tube package 46 by covering a radially inner portion of the same.

Figures 2, 2A, 2B, 2C:
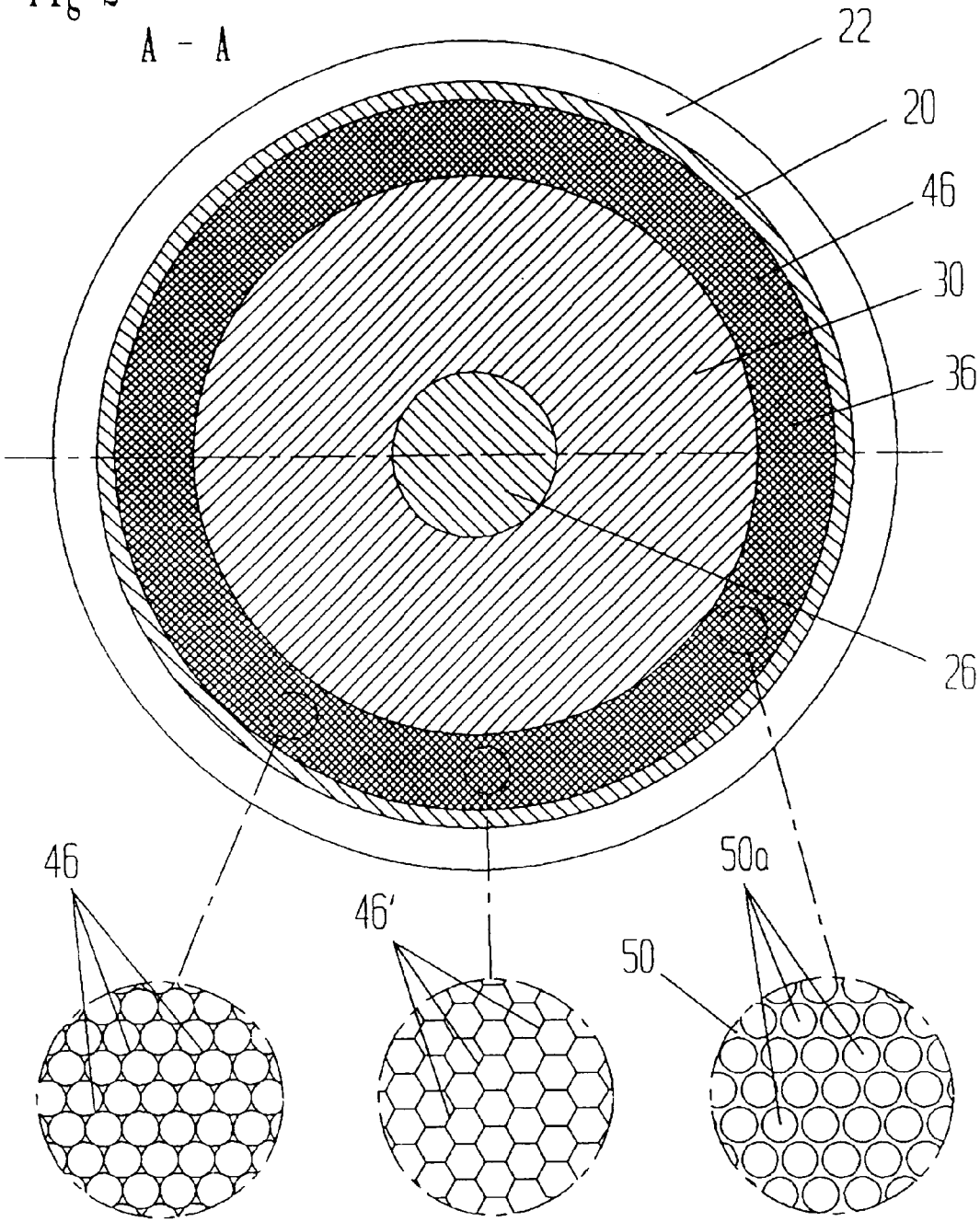
FIG. 2 is a cross-sectional view of the separation device, taken along the line 2—2 in FIG. 1.
FIG. 2*a* shows on a larger scale a portion of a first embodiment of a bundle of tubes in the separation zone.
FIG. 2*b* shows on a larger scale a portion of a second embodiment of the tube or channel cross-section in the separation zone.
FIG. 2*c* shows on a larger scale an embodiment where the separation surface elements are formed by a plurality of adjacent axial channels or holes in a rotational body.

FIG. 2 shows the separation rotor 12 in cross section. FIG. 2*a* shows the tubes 46 in a circle on an enlarged scale. The annular separation chamber 36 can have, depending on the dimensioning of the device, several thousand tubes 46. Suitably, the tubes 46 consist of the desired lengths of conventional "drinking straws". This means that the weight of the package of separation elements will be very small and the manufacturing cost will be low. The tubes 46 can be made as a coherent annular cassette which can be sealed in a suitable manner in the spaces between the individual tubes 46, for example at the end portions of the tubes, in order to prevent, if desired, flow of liquid in the spaces between the tubes.

FIG. 2*b* shows an alternative embodiment of the tubular element in the form of tubes 46' of hexagonal shape, arranged in the form of a "honeycomb". This honeycomb can also be obtained by assembling profiled sheets or plates.

FIG. 2*c* shows an additional alternative embodiment where the tubular elements 46,46' have been replaced by a body 50 of material, in which a number of axial holes or channels 50*a* are made, the walls of which form sedimentation surfaces as do the walls of the tubes 46,46'.

Figure 3:
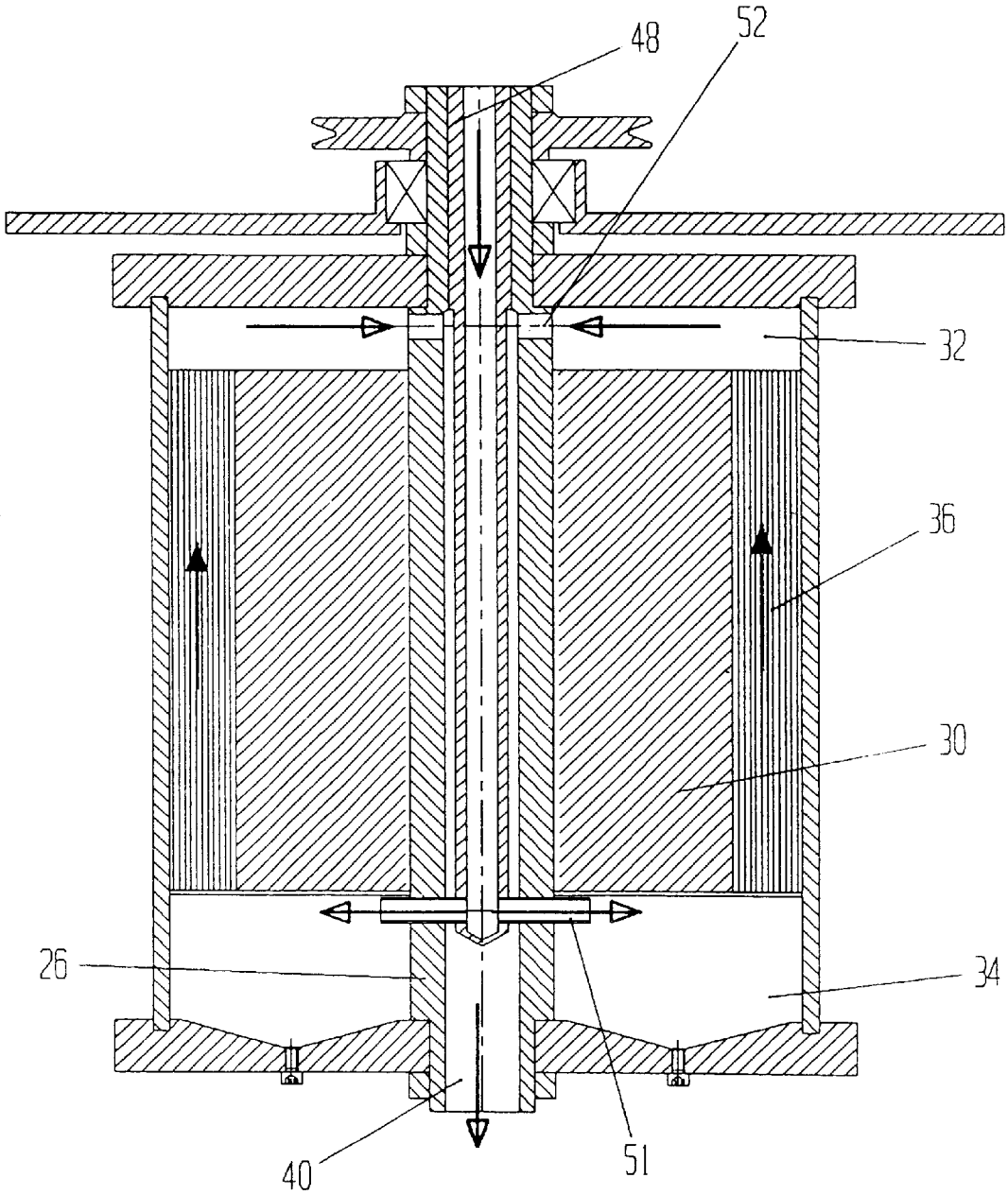
FIG. 3 is a schematic side view of a second embodiment of a separation device according to the present invention.

FIG. 3 shows another embodiment of the separation device according to the invention, where the device essentially corresponds to that shown in FIG. 1, but where the separation instead is done counter to the gravitional direction in the separation chamber 36. The liquid mixture to be separated is introduced through an inlet pipe 48 into the rotary shaft 26 and is introduced into the lower collection chamber 34 via radial inlet tubes 51. In the collection chamber 34 there is an acceleration and rotation of the liquid together with the rotor, and thus any larger particles can be separated in the chamber 34 itself, before the liquid enters the tubes 46 in the upward flow direction therethrough for deposit of smaller, more difficultly separated particles during substantially laminar flow conditions in the tubes 46. The separated liquid flows thereafter into the upper collection chamber 32 and flows out via outlet holes 52 to the outlet 40 in the rotor shaft 26. In this embodiment, the sediment collected on the tube walls has a shorter distance to move during the emptying phase, since the sediment has a tendency to be deposited in larger quantity towards the bottom of the tubes 46.

Figure 4:
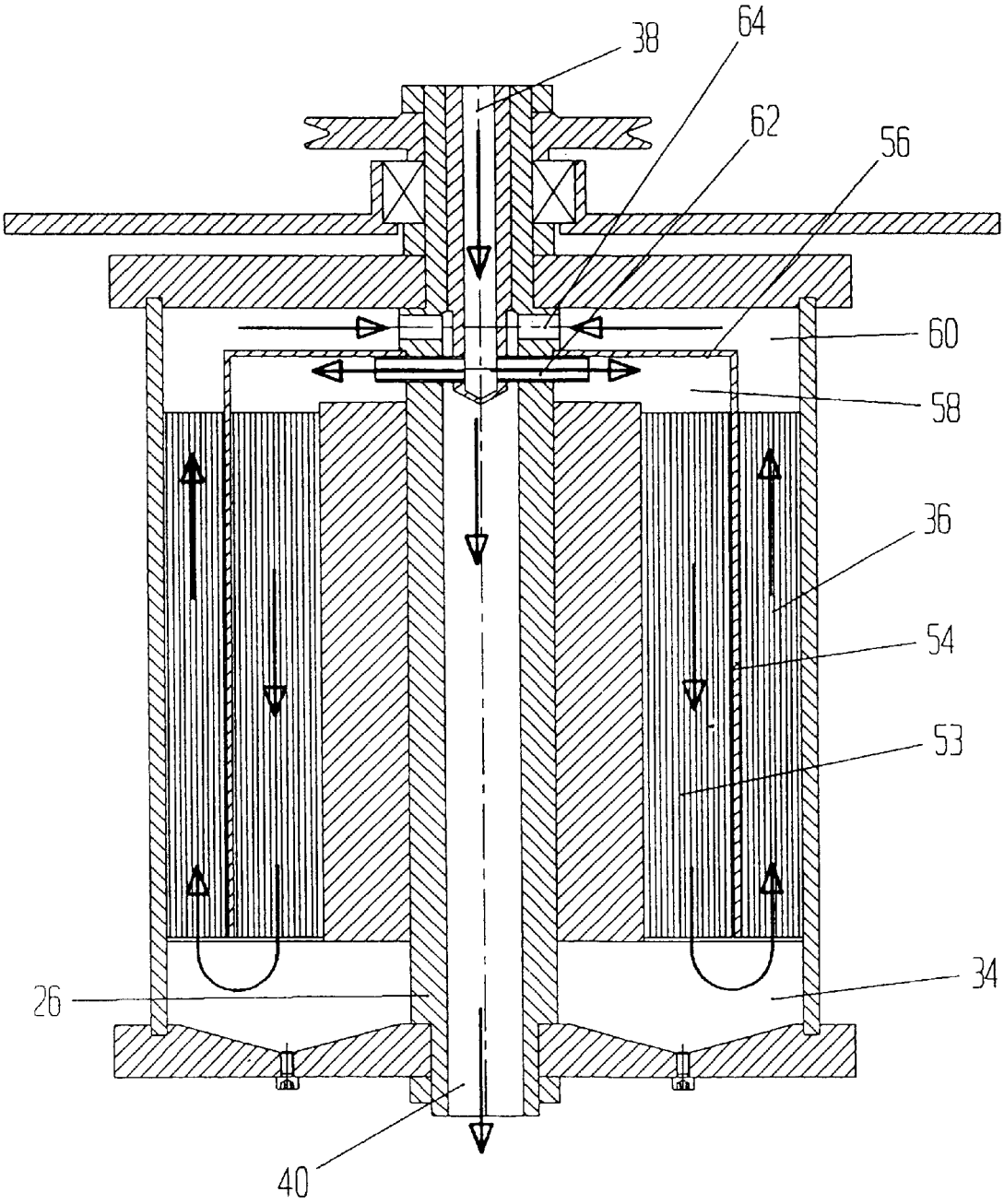
FIG. 4 is a schematic side view of a third embodiment of a separation device according to the present invention.

FIG. 4 shows a third embodiment of the separation device according to the invention, where the device essentially corresponds to those described above, but where the separation is carried out in tube coaxial separation chambers 36 and 53, both packed with tubular separation elements 46 as described previously. The outer separation chamber 36 is separated from the inner chamber 53 by means of a cylindrical separating wall 54, which extends upwards into the upper collection chamber and, together with a horizontal wall portion 56 divides the upper collection chamber into an inlet chamber portion 58 and an outlet chamber portion 60. The second, closed collection chamber 34 consists in this embodiment of a flow turning and sedimentation chamber. As can be seen in FIG. 4, the mixture liquid is conducted via the inlet 38 and the radial inlet tubes 62 into the inlet chamber portion 58, and passes thereafter through the inner separation chamber 53 in the gravitational direction, there thus occurring a first separation of easily separable material, before the liquid flow is turned in the chamber 34 and caused to flow against the gravitational direction in the outer separation chamber 36, where, thanks to a higher g-number, the main separation of small, difficultly separable particles takes place, before the effluent thereafter leaves the rotor via the radial holes 64 and the outlet 40 in the rotor shaft 26.

Figure 5:
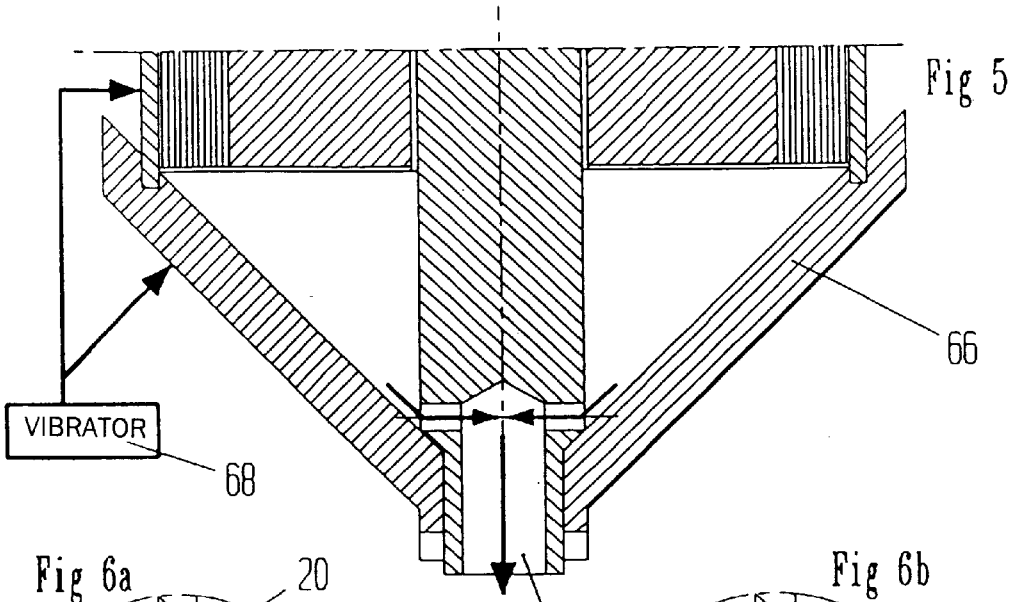
FIG. 5 shows a modified embodiment of the outlet portion of the separation device according to the invention.

When the sedimentation capacity of the tube package has been reached and the particle percentage of the effluent increases, the flow and the rotation are stopped, and the sediment, due to gravity and the low friction against the walls of the plastic tubes, will slide down into the chamber 34, from which the sediment can be emptied as described previously or through other methods which are described below with reference to FIGS. 5–7. An advantage with the two-chamber design in FIG. 4 is that the larger, heavier particles, which were separated out in the inner chamber 53, are subjected to a lower g-number and therefore have not been packed too hard for effective emptying. Vibration or flushing may be required for complete draining, and a buffer tank (not shown) connected to the apparatus inlet will make possible continuous flow in the rest of the process if this is required during the relatively short emptying time.

Emptying of the sediment chamber 34 can be carried out by various methods depending on the type of sediment. FIG. 5 shows an embodiment with a conical bottom 66, where the sediment is drained by gravity and leaves the device via the effluent outlet 40 when the rotation ceases. A vibrator 68 can be arranged to vibrate the separation rotor 12 to efficiently empty out the sediment.

Figure 6A:
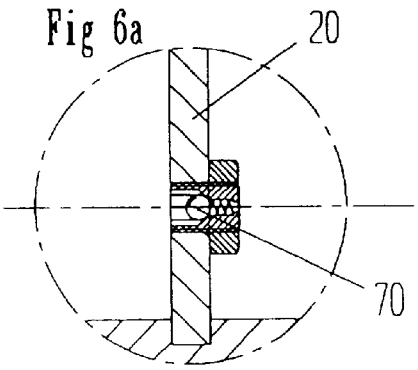
FIGS. 6*a* and 6*b* show a conceivable design of one sediment outlet opening, which can be closed by centrifugal force in the device according to the invention.
Figure 6B:
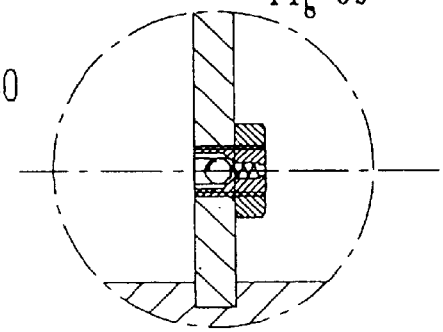

FIG. 6*a* shows an embodiment with a ball valve 70 biased with a helical spring and mounted in the rotor wall 20. The mass of the ball and the spring force are adapted so that the valve during rotation is kept closed by the centrifugal force, while FIG. 6*b* shows how the spring force has opened the valve when the rotational speed drops and thus allows draining of the sediment.

Figure 7:
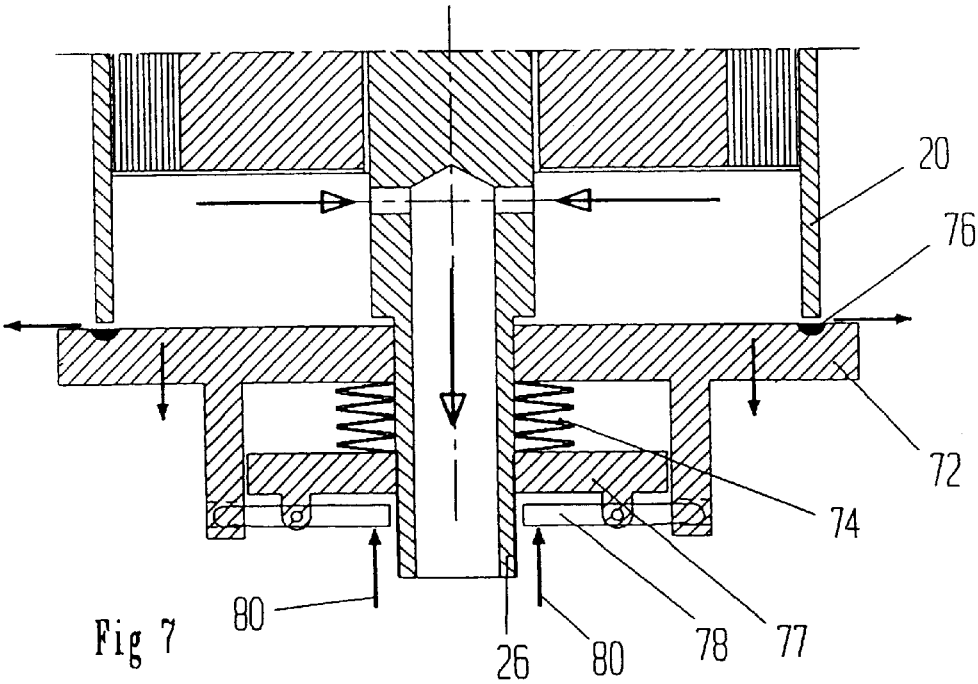
FIG. 7 shows another conceivable design of a sediment outlet for the separation device according to the invention.

FIG. 7 shows an emptying system consisting of an axially spring-biased valve which can be opened manually or automatically with the aid of a control means. A bottom plate 72 is in this case non-rotatably mounted on the rotor shaft 26 and is movable axially. The bottom plate is provided with a spring housing for a compression spring 74 and a seal 76-which seals against the rotor wall 20. Levers 78 are mounted in a spring holder 77 fixed on the rotor shaft 26. By activating the levers 78 as indicated by the arrows 80 in the Figure, the spring force holding the seal 76 closed is counteracted and the seal is opened so that the sediment can be emptied. The centrifuge, when the separation chamber 36 is filled with sediment, must first be stopped in order to allow the sediment to slide down into the collection chamber 34. The valve is thereafter opened as described above and the machine is started so that the sediment will be slued out by centrifugal force, whereafter the valve is closed and the flow is coupled in and the separation process continues. Below there will be described a pair of practical examples.

EXAMPLE 1

A test separation of yeast cells (baker's yeast) was performed in a separation device according to the first described embodiment shown in FIG. 1. The greatest radius of the separation chamber 36 was 150 mm and the smallest radius was 125 mm and it was packed with 2400 tubes of polypropylene material with a diameter of 3.00 mm and a material thickness of 0.2 mm. The centrifuge rotated at 310 rpm and thus generated circa 16 g's in the outer portion of the sediment chamber.

The yeast was mixed with water so that a suspension of 0.9% by volume of yeast was obtained. The suspension was pumped into the centrifuge using a hose pump the capacity of which could be varied by adjusting the rotational speed. The yeast concentration was determined by centrifuging in a laboratory centrifuge for 1.5 minutes at 11000 g's and read in graduated centrifuge tubes. The separation was performed at room temperatures of circa 20° C. and the results are given in the table below:

| Flow, liters/h | 23 | 60 | 94 | 132 |
|---|---|---|---|---|
| Yeast concentration in input flow, % by volume | 0.9 | 0.9 | 0.9 | 0.9 |
| Yeast concentration in output flow, % by volume | 0.05 | 0.08 | 0.15 | 0.20 |
| Yeast separation, % | 94 | 91 | 84 | 79 |

After testing, the machine was allowed to work at about 100 liters per hour. When the yeast concentration in the effluent showed a tendency to increase, the flow was stopped and the rpm was gradually lowered so that the machine was slowly emptied of separated liquid. When the yeast began to leave the machine, a vessel was placed under the outlet 40 and the rotation was stopped completely. In order to empty the remaining yeast, two 10 mm drain plugs 44 in the bottom 24 of the sediment chamber 34 were opened, so that all the yeast concentrate could be drained. The collected yeast concentrate was analyzed and was found to contain circa 60% by volume yeast. The machine was disassembled and only insignificant amounts of yeast were found to remain in the tubes, which shows that the sediment can be easily drained from the separation chamber when the machine has worked at the above mentioned g-numbers.

EXAMPLE 2

A corresponding test separation of yeast was carried out in the separation device provided with two concentric annular separation chambers 36,53 as shown in FIG. 4. The outer chamber 36 had the same dimensions as in Example 1, and the inner chamber's 52 greatest radius was 117 mm and the smallest radius was 75 mm and was packed with 2800 tubes of the same type as in the example above. The highest g-number in the inner separation chamber 53 was 12. The machine was operated at the same rpm except for the last sampling, when the rpm was raised to 420 rpm. The separation results are given in the following tables:

Test A

| Input flow, 1/h | 23 | 38 | 60 | 132 |
|---|---|---|---|---|
| Yeast conc. in input flow, % by volume | 1.0 | 1.0 | 1.0 | 1.0 |
| Yeast conc. in output flow, % by volume | 0.00 | 0.02 | 0.025 | 0.20 |
| Yeast separation, % | 100.0 | 98.0 | 97.5 | 80.0 |

Test B

| R.p.m. | 310 | 310 | 310 | 310 | 310 | 420 |
|---|---|---|---|---|---|---|
| Input flow 1/m | 23 | 38 | 60 | 94 | 132 | 132 |
| Yeast conc. input flow, % by vol. | 1.5 | 1.5 | 1.5 | 1.5 | 1.5 | 1.5 |
| Yeast conc. output flow, % by vol. | 0.00 | 0.01 | 0.02 | 0.05 | 0.15 | 0.06 |
| Yeast separation, % | 100.0 | 99.3 | 98.7 | 96.7 | 90.0 | 96.0 |

The separation result from Test B verifies essentially the result from Test A, i.e. that a very good separation is obtained up to a capacity of circa 50.6 liters/hour and that a pronounced improvement is obtained at the highest capacity 132 l/h when the rpm was increased from 310 to 420 rpm or from 16 to 22 g's in the outer separation chamber 36. It was also shown that even with two separation chambers 36,53 and the higher rpm, the yeast concentrate could be efficiently emptied from the chamber 34 when the rotation was stopped.

It is possible within the scope of the present invention to vary the construction of a number of the components in the separation device. For example, the cross-sectional profile of the surface-creating tubular elements or channels can have another shape than what has been mentioned and shown here, for example other polygon shapes or oval shape. The solid filler 30 can be replaced by a hollow body. The inlets and outlets can be suitably dimensioned at the same size, thus to reduce the pressure drop in the device.

What is claimed is:

1. A device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements, wherein the sedimentation surface elements are formed by a plurality of adjacent tubular elements having first and second ends and which are oriented axially and arranged to form a ring about the center axis of the rotatable vessel and which are open at both ends, wherein the tubular elements are arranged in two concentric annular formations which are separated from each other by a liquid-tight intermediate wall and the upper collection chamber above the tubular elements is divided into an inlet chamber portion and an outlet chamber portion, the inlet chamber portion communicating with a radially inner annular formation of the tubular elements, while the outlet chamber portion communicates with a radially outer annular formation of the tubular elements.

2. A device according to claim 1, wherein the lower collection chamber beneath the tubular elements in the vessel constitutes a flow-turning chamber for the liquid which is separated, and a collection and emptying chamber for particle sediment deposited on the sedimentation surface elements.

3. A device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements, wherein the sedimentation surface elements are formed by a plurality of adjacent tubular elements having first and second ends and which are oriented axially and arranged to form a ring about the center axis of the rotatable vessel and which are open at both ends, wherein the tubular elements have a diameter of at least 2 mm and not greater than 10 mm and are carried by a bottom plate of fine-meshed net structure.

4. A device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements, wherein the sedimentation surface elements are formed by a plurality of adjacent tubular elements having first and second ends and which are oriented axially and arranged to form a ring about the center axis of the rotatable vessel and which are open at both ends, wherein the vessel is rotatably mounted in an overlying carrier over a rotational shaft nonrotatably joined to the vessel, said shaft having an inlet hole for the liquid which is to be separated.

5. A device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements, wherein the sedimentation surface elements are formed by a plurality of adjacent tubular elements having first and second ends and which are oriented axially and arranged to form a ring about the center axis of the rotatable vessel and which are open at both ends, wherein the vessel, for forming a sediment outlet, has a bottom element which is axially movable between a sealed closed position against a lateral limiting wall of the vessel and an open position spaced from the lateral limiting wall.

6. A device for discontinuous separation of solid particles from a liquid by centrifugal sedimentation thereof, comprising a vessel rotatable about a vertical axis, said vessel having an inlet for the liquid which is to be separated, a separation zone with sedimentation surface elements, upper and lower collection chambers communicating with the separation zone, an outlet for liquid which has been freed of particles in the separation zone, and an outlet which can be opened and closed, for particle sediment collected on the sedimentation surface elements, wherein the sedimentation surface elements are formed by a plurality of adjacent tubular elements having first and second ends and which are oriented axially and arranged to form a ring about the center axis of the rotatable vessel and which are open at both ends, wherein sediment outlet valves which can be closed by centrifugal forces, are arranged on a lateral limiting wall of the vessel.

7. A process for discontinuous separation of solid particles from a liquid by centrifugal sedimentation thereof, comprising the steps of conducting a liquid-particle mixture, which is to be separated into an inlet chamber of a rotating separator vessel, where the liquid-particle mixture is caused to rotate with the rotation of the vessel, wherein the liquid-particle mixture is thereafter caused to flow with substantially laminar flow through a plurality of circumferentially and radially adjacent, parallel channels having first and second ends and further having walls and arranged axially around the center axis of the vessel and open at the first and second ends, the particles in the liquid-particle mixture flowing through the channels being subjected to a g-number of less than 500 to be sedimented by centrifugal forces onto the channel walls, while the separated, cleaned liquid is conducted to an outlet, and, when the particle concentration in the cleaned liquid exceeds a predetermined value, halting the inflow of the liquid-particle mixture and the rotation of the separator vessel to empty the particle sediment collected on the channel walls through an openable outlet which communicates with the channels.

8. A process according to claim 7, wherein the liquid mixture is conducted in a direction vertically upwards through the channels.

9. A process according to claim 7, wherein the liquid mixture is conducted in a direction vertically downwards through the channels.

10. A process according to claim 7, wherein the liquid mixture is conducted vertically downwards in a radially inner group of channels and is thereafter conducted vertically upwards through a radially outer group of channels.

11. A process according to claim 7, wherein the vessel is caused to vibrate upon emptying of sediment.

* * * * *